US006061032A

United States Patent [19]

Sandstedt et al.

[11] Patent Number: 6,061,032

[45] Date of Patent: May 9, 2000

[54] DEVICE IN ANTENNA UNITS

[75] Inventors: Jonas Sandstedt, Göteborg; Göran Snygg, Partille; Björn Johannisson, Kungsbacka, all of Sweden

[73] Assignee: Telefonaktiebolaget LM Ericsson, Stockholm, Sweden

[21] Appl. No.: 09/023,428

[22] Filed: Feb. 13, 1998

[30] Foreign Application Priority Data

Feb. 14, 1997 [SE] Sweden ..... 9700540

[51] Int. Cl.[7] ..... H01Q 13/10

[52] U.S. Cl. ..... 343/770; 343/700 MS; 343/767

[58] Field of Search ..... 343/700 MS, 767, 343/770; H01Q 1/38, 13/10

[56] References Cited

U.S. PATENT DOCUMENTS

| | | | |
|---|---|---|---|
| 3,550,141 | 12/1970 | Harris et al. | 343/767 |
| 4,903,033 | 2/1990 | Tsao | 343/700 MS |
| 4,916,457 | 4/1990 | Foy et al. | 343/770 |
| 4,929,959 | 5/1990 | Sorbello et al. | 343/700 MS |
| 5,241,321 | 8/1993 | Tsao | 343/700 MS |
| 5,510,803 | 4/1996 | Ishizaka et al. | 343/700 MS |
| 5,534,877 | 7/1996 | Sorbello et al. | 343/700 MS |
| 5,798,734 | 8/1998 | Ohsuka et al. | 343/700 MS |

FOREIGN PATENT DOCUMENTS 0735610 10/1996 European Pat. Off. ..... H01Q 21/24

*Primary Examiner*—Don Wong
*Assistant Examiner*—Hoang Nguyen
*Attorney, Agent, or Firm*—Burns, Doane, Swecker & Mathis, L.L.P.

[57] ABSTRACT

Dual polarized antenna device for wireless transmission of information using electromagnetic signals with polarizations orthogonal to each other, with at least one antenna element and at least one ground plane made from a first electrically conducting layer, at least one feeder network made from a second electrically conducting layer and a plurality of apertures in said ground plane, which apertures each consist of one or several aperture sections, and which extend between two end points, which apertures are arranged in at least one aperture group, with each aperture group being symmetrical relative to the planes which are defined by the two polarizations, and with each aperture group consisting of at least one first aperture, which aperture is centrally positioned in the group and is intended for the first polarization, and at least two outer apertures intended for the second polarization, symmetrically positioned on each side of the central aperture with the distance along a straight line between the end points of at least one of the apertures along an imagined line parallel to the main direction of the aperture being less than the total sum of the lengths of the sections of the aperture.

19 Claims, 6 Drawing Sheets

DEVICE IN ANTENNA UNITS

TECHNICAL FIELD OF THE INVENTION

The present invention relates to an antenna device for wireless transmission of information, using electromagnetic signals of two different polarizations.

BACKGROUND

In systems for wireless transmission of information using electromagnetic signals, for example cellular telephony, the area which is covered by the system is often divided into smaller areas, so-called cells. In each cell there is a centrally located so-called base station, with which each user of the system in the cell communicates. It is necessary that the antennas of the base stations are installed in positions which are high above ground, and thus clearly visible in cities, for example on rooftops, walls, etc. For aesthetic reasons this, of course, creates a requirement for making the base stations as compact as possible.

Another requirement on the base stations is for them to use as little energy as possible. So far, to a great extent, base stations have been used which are essentially omnidirectional, in other words they transmit equal amounts of energy in all directions. Modern technology, however, permits the building of so-called "steerable antennas", which means that the beam, or lobe, of the antenna is directed only in the direction where there is a subscriber at the moment. The beam can then be controlled to follow the subscriber during his movement in the cell.

The same modern technology enables one and the same antenna to have a plurality of steered beams, which are then directed in those directions where there at the moment are subscribers. It will be realised that if energy is only transmitted in directions where there are subscribers at the moment, this will permit energy to be saved. This "energy gain" can be used either to increase the range in those directions in which there is transmission, or to lower the output power of the antenna while maintaining the same range.

A common method of building steerable antennas is so-called group antennas. These are, as is indicated by the name, actually groups of antennas, often arranged in columns with several columns next to each other. Each separate antenna in such a column can consist of one antenna element, usually designed in so-called microstrip technology, which is excited by apertures in a ground plane. The apertures are arranged in groups, one for each antenna element, with one or several apertures in each aperture group, and are fed by means of a feeder network which is arranged in a further plane. The feeder network is also designed in microstrip technology. The feeder network may only cross the apertures in the connection points, the so-called feeding points. This means that the distance of the feeder network from the centre of the aperture groups to a great degree is decided by the extension of the apertures.

The feeder networks for the different columns may of course not cross each other either.

In order to avoid so-called grating lobes, i.e. lobes in undesired directions, the columns of the group antenna should be as closely positioned to each other as possible, especially in systems where one or several lobes are steered to a large angle relative to the normal of the antenna surface. The centre distance between the columns should be significantly less than one wavelength $\lambda$; preferably it should be less than 0,5 $\lambda$.

Efficient design of group antennas, in other words, brings with it requirements for a compact antenna design, in which the feeder network can be arranged as close as possible to the centre of the aperture group.

In order to increase the availability of the system, so-called polarization diversity is often used, which means that each antenna in the group antenna is utilized in two directions of polarization. This, for example, makes it possible to receive signals which have had their polarization shifted as a result of reflections against surrounding objects, a phenomenon which can be particularly difficult in cities. In order to achieve a good isolation between the directions of polarization, it is extremely important that the antenna is symmetrical.

U.S. Pat. No. 4,903,033 shows a design for dual polarized antennas with a feeder network which, if two or several such antennas are to be connected to each other, can be said to require a great deal of space.

In "Proceedings of 16th ESA workshop on dual polarization antennas" there is on page 87, FIG. 13, a design for dual polarized antennas which permits a high degree of isolation between the directions of polarization, but if columns of two or several such antennas are to be connected it might be said that the distances between the feeder networks cause the columns to be placed farther apart than is desirable.

The object of the present invention is thus to obtain a dual polarized antenna intended to be part of a group antenna for wireless transmission of information using electromagnetic signals, which antenna is compact, has a high degree of symmetry, and permits the feeder network to be arranged closer to the centre of the aperture groups than previously.

SUMMARY

The object of the invention is achieved by means of an aperture configuration in a ground plane, with the apertures consisting of one or several aperture sections and extending between two end points. The apertures are arranged in aperture groups, one for each antenna element, with each aperture group being symmetrical relative to both of the planes which are defined by the two polarizations for which the antenna is intended. Each aperture group consists of at least one aperture which is centrally located in the group and is intended for one of the polarizations, and at least two outer apertures intended for the other polarization, which two apertures are symmetrically positioned on one side each of the central aperture to which they are orthogonal.

The area which is enveloped by an aperture group is reduced by means of the invention, since the distance along a straight line between the end points of at least one of the apertures of each group, seen along a line which is parallel to the main direction of the aperture is less than the total sum of the lengths of the sections which the aperture comprises. Since the area which is enveloped is thus reduced, the feeder network can be brought closer to the centre of the aperture group.

BRIEF DESCRIPTION OF THE DRAWINGS

The invention will in the following be described by means of an example of an embodiment, with reference to the appended drawings, in which.

DETAILED DESCRIPTION

Figure 1:
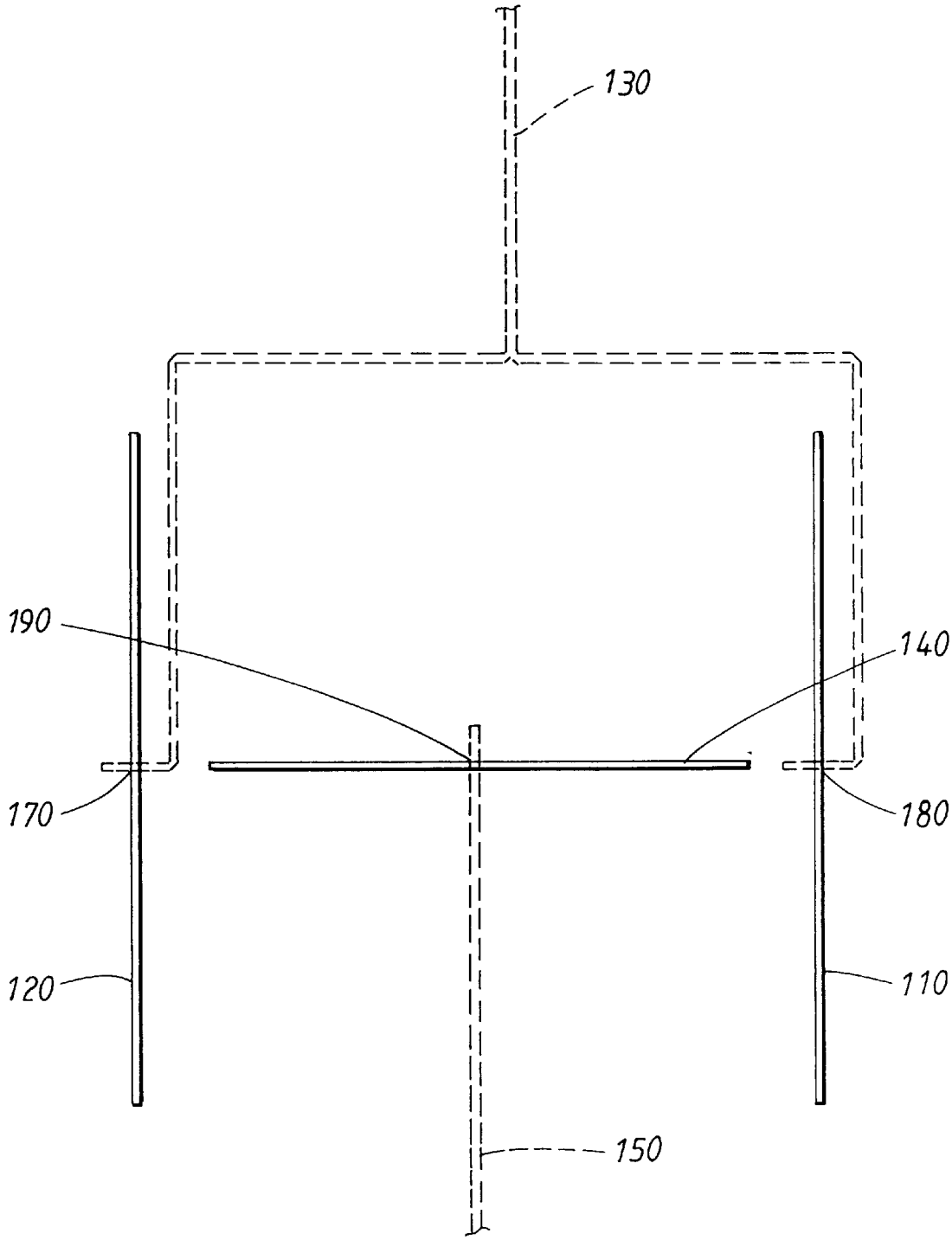
FIG. 1 (PRIOR ART)
FIG. 1 is a schematic plan view of an aperture group with a corresponding feeder network according to prior art.
Figure 2:
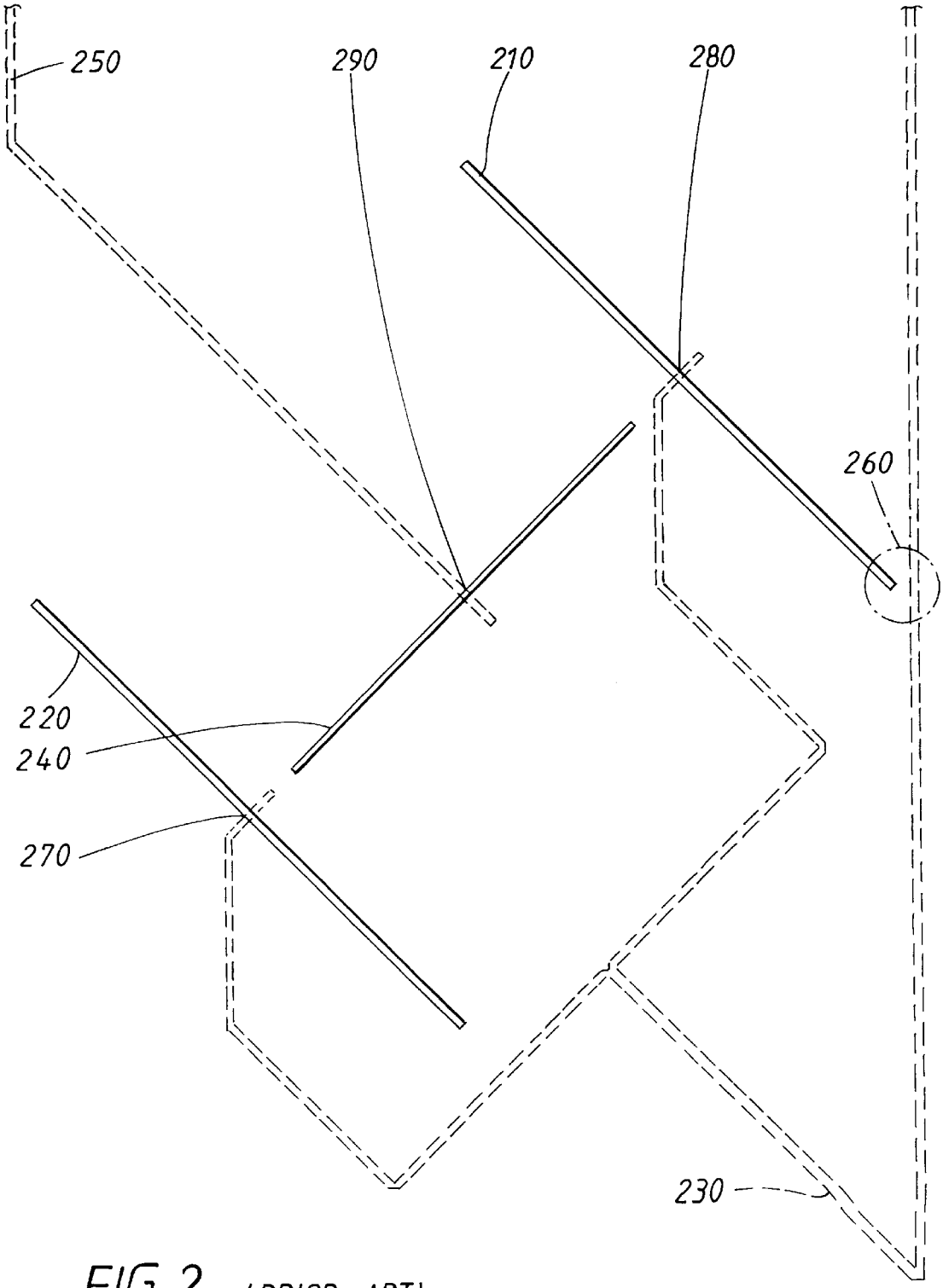
FIG. 2 (PRIOR ART)
FIG. 2 shows a plan view of the device of FIG. 1 arranged as a part of a group antenna, FIG. 3 in plan view shows a comparison between prior art and the invention.

FIGS. 1 and 2 show examples of designs which can be said to be known. The apertures 110, 120 and 140 are arranged in an aperture group. The apertures 110, 120 are intended for a first polarization, and are fed using a feeder network 130 in the feeding points 170 and 180. The aperture 140 is intended for a second polarization, orthogonal to the first. The aperture 140 is fed by means of a second feeder network 150 in a feeding point 190.

FIG. 2 shows an aperture group according to FIG. 1, arranged to be part of a group antenna. As indicated above, the orientation of the apertures determines the polarization. When using dual polarization, it has often turned out to be advantageous if the two polarizations are at ±45° in relation to an imagined vertical line, for which reason the apertures in the example are oriented in this manner. The feeder networks 230, 250 have here been given a somewhat different shape compared to the feeder networks of FIG. 1, since they are intended to connect a plurality of aperture groups.

The circle 260 of FIG. 2 is intended to show the limiting factor for how close the feeder network can be to the centre of the aperture group. The feeder networks may only cross the apertures in the feeding points 270, 280 and 290. The same problem of course arises for both of the feeder networks 230, 250.

Figure 3B:
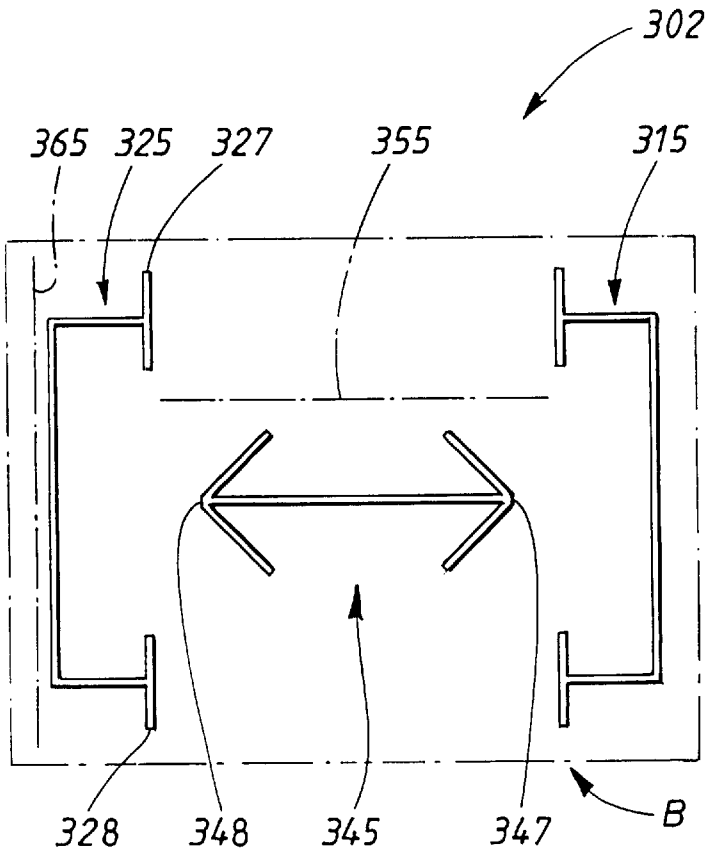
Figure 3A:
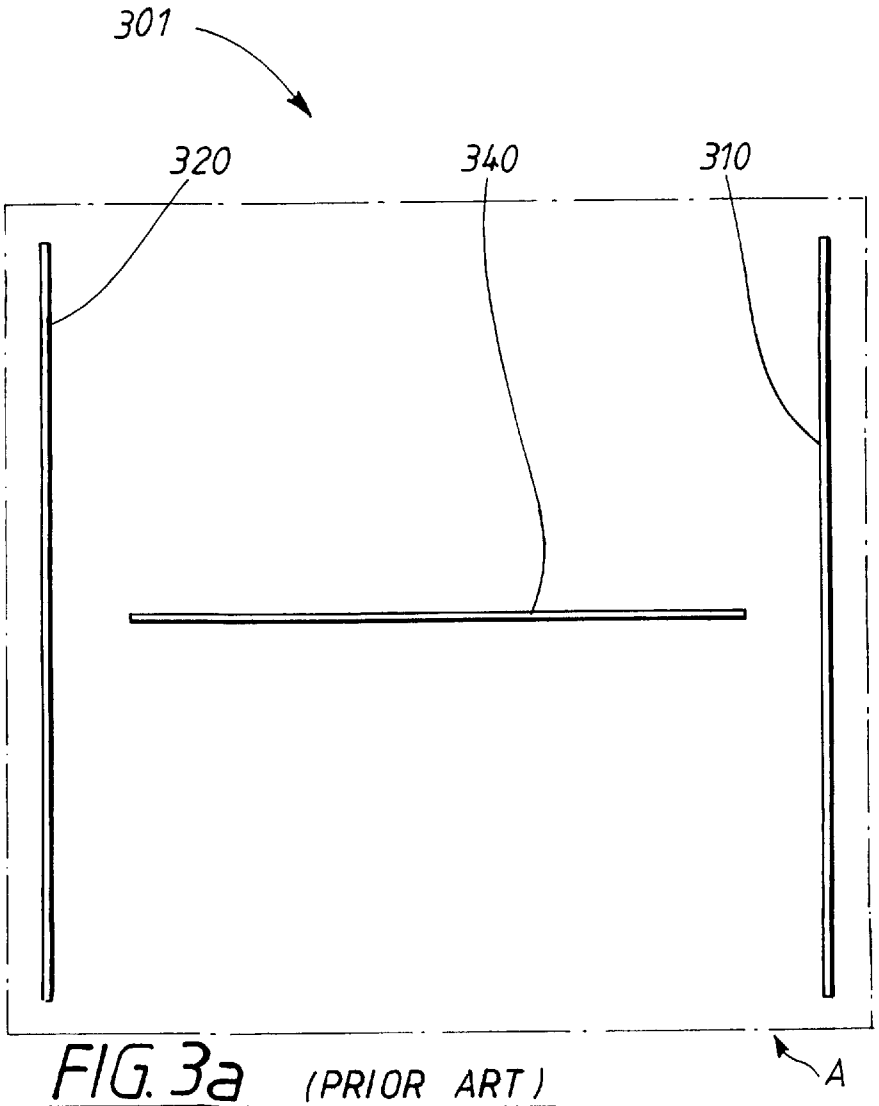
FIG. 3a (PRIOR ART)

FIG. 3*b* is intended to illustrate how the object of the invention is achieved. The total enveloping area A which the left aperture group 301 of FIG. 3*a*, designed according to previously known technology, defines has, by means of the aperture group 302 of FIG. 3*b* designed according to the invention, been reduced to the enveloping area B. This is obtained since the apertures 315, 325, 345 of the aperture group 302 consist of a plurality of aperture sections. The apertures 315, 325, 345 are formed by the aperture sections in such a manner that, along an imagined straight line 355, 365 which is parallel to the main direction of each aperture, the distance between the end points of each aperture 315, 325, 345 is smaller than the total sum of the lengths of the aperture sections of which each aperture consists. The term "end points" here refers to those points of each aperture which are the farthest apart from each other on said lines 355, 365, in other words the points 327–328 and 347–348 respectively in FIG. 3.

It should be pointed out here that, although the length of an aperture determines the frequency area in which the aperture operates, the total sum of the lengths of the aperture sections of which each aperture 315, 325, 345 consists does not necessarily need to be the same as the length of the corresponding apertures according to prior art 310, 320 and 340. It has been shown that, with two apertures which operate within essentially the same frequency range, and where one of the apertures consists of one straight section and the other consists of a plurality of sections which are at different angles to each other, the sum of the lengths of the sections of the "non-straight" aperture does not need to be equal to the length of the straight aperture.

Figure 4:
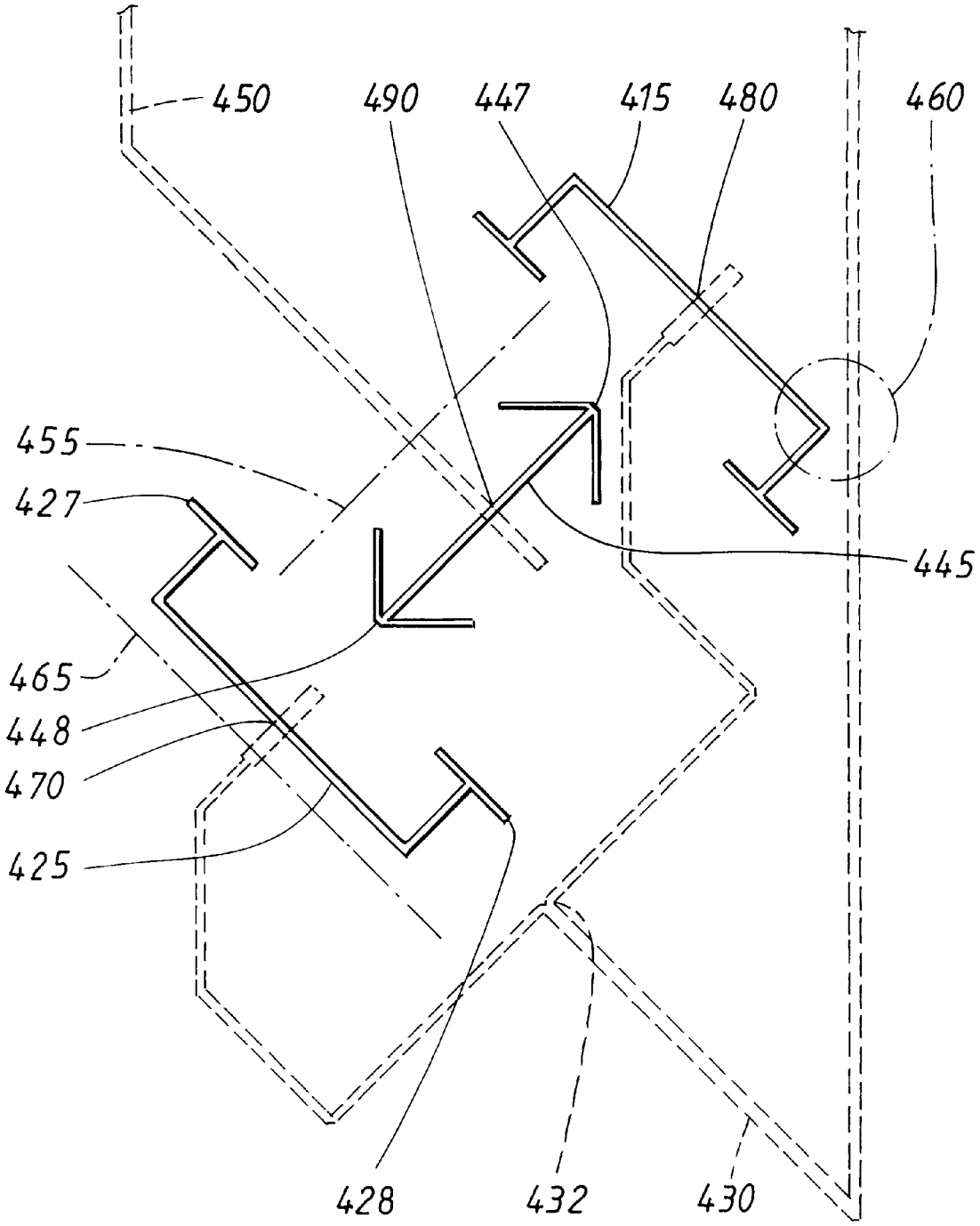
FIG. 4 shows a plan view of an antenna with an aperture group according to the invention, arranged as a part of a group antenna, FIG. 5 schematically shows an end view of an antenna according to the invention in a preferred embodiment.

FIG. 4 shows how an aperture group according to the invention has been arranged to be part of a group antenna. The circle 460 is intended to show that, by means of the invention, at least the feeder network 430 for one of the polarizations can be arranged closer to the centre of the aperture group than previously.

As can be seen in FIGS. 3 and 4, an aperture group according to the invention has a reduced envelope area with complete symmetry in those planes which are defined by the two directions of polarization. It should be pointed out that the requirement for symmetry also applies to the feeding points 470, 480 and 490 which, in other words, need to be positioned symmetrically along the two directions of polarization.

It should, furthermore, be emphasized that the requirement for symmetry only applies to those parts of the antenna which are intended to radiate, in other words the aperture group and the feeding points in FIG. 4, and the antenna elements not shown in FIG. 4.

Figure 5:
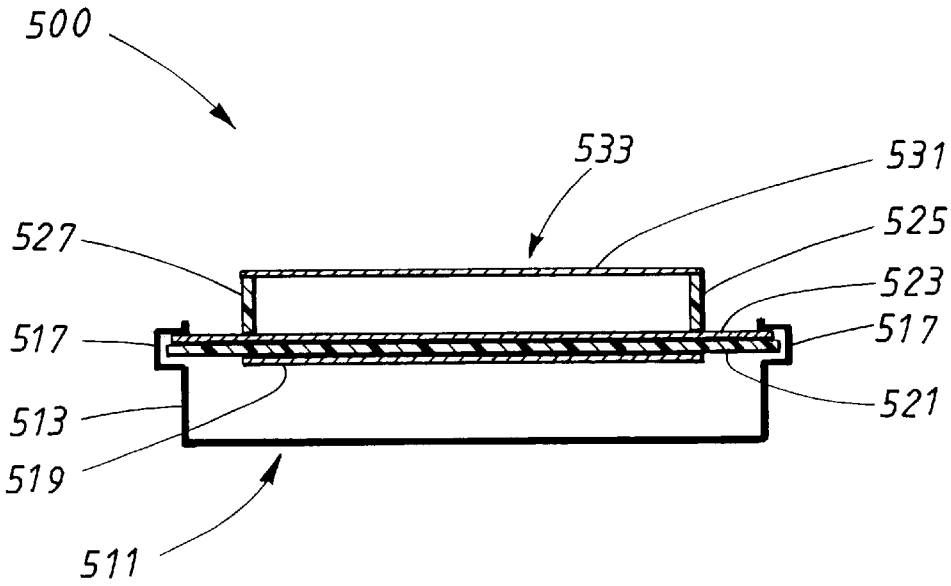

FIG. 5 shows a side-view of an antenna device 500 according to the invention in a preferred embodiment. The entire antenna device 500 is arranged in a U-shaped supporting structure 511 of an electrically conducting material. In the structure, there are grooves 517 into which a supporting plate 521 is inserted. Since the supporting structure 511 is U-shaped, an isolating effect in the rear direction is achieved. The walls 513 isolate sideways, which is particularly important if it is desired to design a group antenna with several columns of antennas adjacent to each other. Such a group antenna is formed with a supporting structure which, in principle, is similar to the one in FIG. 5, with a common rear section and separating walls which mechanically and electrically separate the columns from each other.

In the example shown there is an antenna plane 533 consisting of an antenna element 531. There is furthermore, as mentioned above, a supporting plate 521 designed in a dielectric material. The feeder networks are made of an electrically conducting layer 519 which is arranged on that side of the plate 521 which faces away from the antenna plane 533. The aperture group according to the invention is made in a ground plane 523 which is arranged on that side of the plate 521 which faces the antenna plane 533.

The antenna element 531 and the ground plane 523 are separated from each other by means of distances 525, 527 made in a dielectric material.

The reason for using dielectric distances is that, in many cases, air is to be preferred as a separating dielectric material. The power losses in air are, for example, smaller than in most other dielectric materials.

Figure 6:
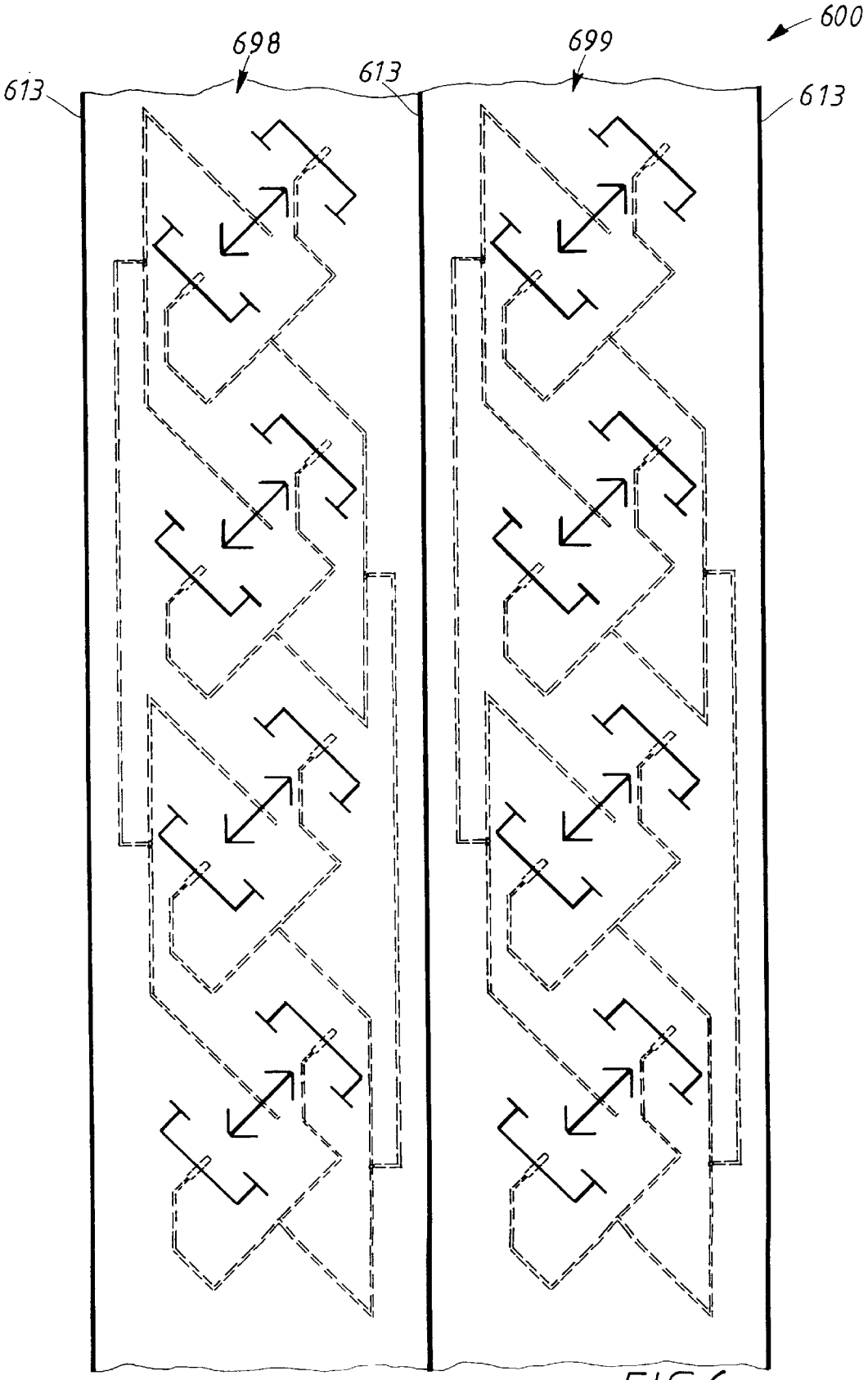
FIG. 6 shows a plan view of a group antenna with aperture groups according to the invention.

Finally, in FIG. 6 a plan view of a group antenna 600 with aperture groups according to the invention is shown schematically. The group antenna 600, in the example shown, consists of two antenna columns 698, 699 arranged next to each other. As has been mentioned above, the supporting structure of such a group antenna is in principle similar to that in FIG. 5. It is, in other words, made from an electrically conducting material, with a common rear section, and the columns 698, 699 are separated from each other and delimited outwards by walls 613. Consistently in this description, the antenna elements have been shown being fed via one feeder network. The antenna according to the invention is of course completely reciprocal, in other words it operates equally well during transmission and reception. The term "feeding" thus comprises both "feeding to" and "feeding from" for example, the antenna elements.

The device is of course not limited to the embodiment described above. A large number of variants are possible, mainly concerning the shape of the apertures, the essential principle is that the aperture group remains symmetrical with reference to the two directions of polarization.

The central aperture 445, for example, has in the drawings consistently been shown as an arrow which points in two directions. It can instead, for example, be shaped so that the sections which start from the two ends of the central sections and which form the heads of the arrow, instead have a different angle relative to the central aperture section. The number of sections which start from the two ends of the central section is not necessarily limited to two, but bearing the symmetry in mind, an equal amount of sections should start from both ends.

The outer apertures 415, 425 have in the figures consistently been shown as consisting essentially of three sections which are orthogonal to the main direction of the central aperture, and two sections which are parallel to the main direction of the central aperture. An example of an alternative solution is to let the outer apertures consist of a first section which is orthogonal to the main direction of the central aperture 445, and two sections which are at another angle relative to the first section.

A variant of the above-mentioned embodiment for the outer apertures is that from each of the two sections which are at an angle relative to the first section a further section extends, which section is at an angle relative to the section from which it extends.

Additionally, in the example dielectric distances 525, 527 have been shown, which separate the antenna element 531 and the ground plane 523, while the ground plane 523 and the layer 519 for feeder network are separated by a dielectric plate 521. What it is desired to obtain is that the antenna element 531, the ground plane 523, and the layer 519 for feeder networks are galvanically separated from each other. To this end, a large number of alternative embodiments are possible which combine dielectric plates and dielectric distances.

In a further alternatively embodiment, the layer 519 for feeder networks can be positioned between the ground plane 523 and the antenna element 531, since this has also been shown to provide a well-functioning device.

What is claimed is:

1. A dual polarized antenna device for wireless transmission of information using electromagnetic signals of a first and a second polarization, which two polarizations are orthogonal to each other, comprising at least one antenna plane with at least one antenna element, and at least one ground plane made from a first electrically conducting layer, at least one feeder network made from a second electrically conducting layer, and a plurality of apertures in the ground plane, wherein each aperture includes at least one aperture section and extends between two end points; the apertures are arranged in aperture groups; each aperture group is symmetrical relative to planes defined by the two polarizations and comprises at least one first aperture, which is centrally located in the group and is intended for the first polarization, and at least two outer apertures, which are intended for the second polarization and are symmetrically positioned on one side each of the first aperture; and a distance along a straight line between the end points of at least one of the apertures along an axis parallel to a main direction of the aperture is smaller than a sum of the lengths of the aperture sections in the aperture.

2. The device of claim 1, wherein at least one first aperture includes a plurality of aperture sections which together form a two-headed arrow.

3. The device of claim 1, wherein at least one first aperture includes a central aperture section, which has a main direction that is orthogonal to the main direction of the outer apertures, and an additional even number of aperture sections, which in equal amounts extend from each end of the central aperture section at an angle relative to the central aperture section, which angle deviates from a straight angle.

4. The device of claim 1, wherein two outer apertures include a plurality of aperture sections, of which at least a first aperture section of the respective two outer apertures extends orthogonally to the main direction of the first aperture and at least two aperture sections that extend at an angle relative to the first section of the respective two outer apertures.

5. The device of claim 4, wherein from each of the at least two extending aperture sections a further aperture section extends at an angle relative to that of the at least two extending aperture sections.

6. The device of claim 1, wherein the ground plane and the second electrically conducting layer are separated from each other by at least one supporting structure made from a dielectrical material.

7. The device of claim 6, wherein the second electrically conducting layer is arranged on a side of the ground plane which faces away from the antenna plane.

8. The device of claim 7, wherein the antenna plane comprises at least one antenna element and is separated from the ground plane and the second electrically conducting layer by at least one distance made from a dielectric material.

9. The device of claim 7, wherein the antenna plane includes at least one antenna element which is supported by a supporting structure, which at least partially fills a cavity down to the closest lower plane.

10. The device of claim 6, wherein the antenna plane comprises at least one antenna element and is separated from the ground plane and the second electrically conducting layer by at least one distance made from a dielectric material.

11. The device of claim 6, wherein the antenna plane includes at least one antenna element which is supported by a supporting structure, which at least partially fills a cavity down to the closest lower plane.

12. The device of claim 1, wherein the ground plane and the second electrically conducting layer are separated from each other by at least one distance made from a dielectric material.

13. The device of claim 12, wherein the second electrically conducting layer is arranged on a side of the ground plane which faces away from the antenna plane.

14. The device of claim 13, wherein the antenna plane comprises at least one antenna element and is separated from the ground plane and the second electrically conducting layer by at least one distance made from a dielectric material.

15. The device of claim 13, wherein the antenna plane includes at least one antenna element which is supported by a supporting structure, which at least partially fills the cavity down to the closest lower plane.

16. The device of claim 12, wherein the antenna plane comprises at least one antenna element and is separated from the ground plane and the second electrically conducting layer by at least one distance made from a dielectric material.

17. The device of claim 12, wherein the antenna plane includes at least one antenna element which is supported by a supporting structure, which at least partially fills a cavity down to the closest lower plane.

18. The device of claim 1, wherein the feeding points for said apertures are symmetrically positioned around the plane of symmetry of the aperture groups.

19. A dual polarized antenna device for wireless transmission of electromagnetic signals having a first polarization and a second polarization, substantially orthogonal to the first polarization, comprising:

at least one antenna plane with at least one antenna element;

at least one ground plane including a first electrically conducting layer having a plurality of apertures formed therein arranged in aperture groups; and at least one feeder network made from a second electrically conducting layer, wherein each aperture includes at least one aperture section and extends between two end points, wherein each aperture group is symmetrical relative to planes defined by the two polarizations and comprises at least a first aperture section, which provides the first polarization, and at least two outer aperture sections, which are symmetrically positioned on opposing sides of the first aperture section and which provide the second polarization, wherein a distance along a straight line between the end points of at least one of the apertures along an axis parallel to a main direction of the aperture is smaller than a sum of the lengths of the aperture sections in the aperture, wherein two outer apertures include a plurality of aperture sections, of which at least a first aperture section of the respective two outer apertures extends orthogonally to the main direction of the first aperture and at least two aperture sections that extend at an angle relative to the first section of the respective two outer apertures and wherein from each of the at least two obliquely extending aperture sections a further aperture section extends at an angle relative to that of the at least two extending aperture sections.

* * * * *